US005124066A

United States Patent [19]

Russell

[11] Patent Number: 5,124,066

[45] Date of Patent: Jun. 23, 1992

[54] STORAGE-STABLE ENZYMATIC LIQUID DETERGENT COMPOSITION

[75] Inventor: Stephen W. Russell, Maasland, Netherlands

[73] Assignee: Lever Brothers Company, Division of Conopco, Inc., New York, N.Y.

[21] Appl. No.: 709,086

[22] Filed: May 30, 1991

Related U.S. Application Data

[63] Continuation of Ser. No. 482,469, Feb. 21, 1990, abandoned.

[30] Foreign Application Priority Data

Feb. 27, 1989 [GB] United Kingdom ..... 8904414
May 24, 1989 [GB] United Kingdom ..... 8911932

[51] Int. Cl.[5] ..... C11D 3/386; C11D 7/42

[52] U.S. Cl. ..... 252/174.12; 252/174.12; 252/DIG. 12

[58] Field of Search ..... 252/DIG. 12, 174.12

[56] References Cited

U.S. PATENT DOCUMENTS

| | | | |
|---|---|---|---|
| 4,206,070 | 6/1980 | Jones | 252/174.21 |
| 4,247,425 | 1/1981 | Egan et al. | 252/548 |
| 4,256,611 | 3/1981 | Egan et al. | 252/548 |
| 4,261,868 | 4/1981 | Hora et al. | 252/529 |
| 4,343,726 | 8/1982 | Egan et al. | 252/547 |
| 4,375,565 | 3/1983 | Greif et al. | 568/622 |
| 4,404,115 | 9/1983 | Tai | 252/135 |
| 4,522,740 | 6/1985 | Schmid et al. | 252/174.21 |
| 4,537,706 | 8/1985 | Severson, Jr. | 252/545 |
| 4,548,727 | 10/1985 | Shaer | 252/171 |

FOREIGN PATENT DOCUMENTS

| | | |
|---|---|---|
| 1092036 | 12/1980 | Canada . |
| 238216 | 9/1987 | European Pat. Off. . |
| 303187 | 2/1989 | European Pat. Off. . |
| 60-941265 | 5/1985 | Japan . |
| 1560419 | 2/1980 | United Kingdom . |
| 2186884 | 8/1987 | United Kingdom . |

*Primary Examiner*—A. Lionel Clingman
*Assistant Examiner*—Kery A. Fries
*Attorney, Agent, or Firm*—Ronald A. Koatz

[57] ABSTRACT

An aqueous liquid detergent composition comprising water, a glyceryl ether of an alkoxylated nonionic surfactant, an enzyme and boric acid or a boron-equivalent thereof capable of reacting with said surfactant.

4 Claims, 1 Drawing Sheet

STORAGE-STABLE ENZYMATIC LIQUID DETERGENT COMPOSITION

Figure 1A:
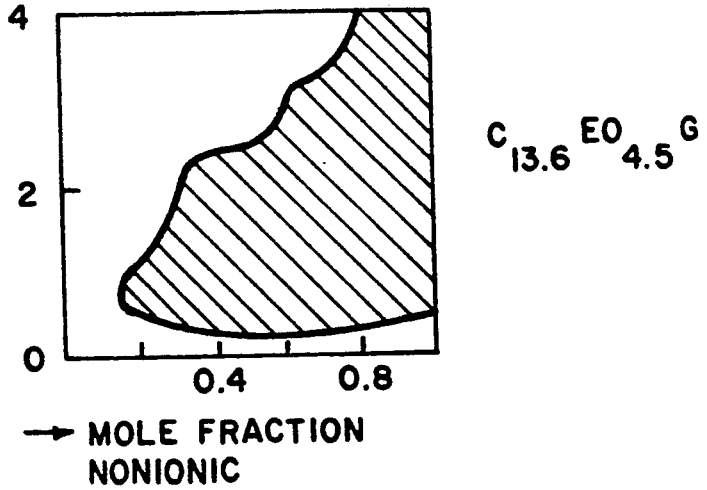

This is a continuation application of Ser. No. 07/482,469, filed Feb. 21, 1990.

The present invention relates to an enzymatic liquid detergent composition, and in particular to such a composition having the benefit to excellent storage stability.

Liquid detergent compositions are well known in the art and have been marketed, for example as fabric washing liquids. Such product will often contain enzymes to improve soil removal performance, but the storage stability of enzyme containing aqueous liquids is not good. This problem is addressed in Canadian patent specification No. CA 1092036 (Unilever Limited - Case no. C 546) where it is proposed to improve stability by the combined use of a boron compound such as borax and a polyhydroxy compound having 2 to 6 hydroxy groups per molecule, such as glycerol.

Such liquid detergent products will usually contain a surfactant and this may be chosen from anionic, nonionic, cationic, amphoteric and zwitterionic materials.

We have now found that the necessity for the presence of the glycerol in such products is avoided if the surfactant is selected, from a specific class of materials.

Thus, according to the invention, there is provided an aqueous liquid detergent composition comprising water, a glyceryl ether of an alkoxylated nonionic surfactant, an enzyme and boric acid or a boron-equivalent thereof capable of reacting with said surfactant.

Glyceryl ethers of alkoxylated nonionic surfactants are known. Thus, British patent specification No. GB 1506419 and U.S. Pat. No. 4206070 (The Procter & Gamble Company) discloses compounds of the formula $$RO(CH_2CH_2O)_nCH_2CH(OH)CH_2OH$$

wherein R is an alkyl or alkenyl group and n is from 1 to 6. Such a surfactant is said to be particularly effective at removing oily stains such as hydrocarbon oil. However, this document gives no suggestion that such a material, together with a boron compound can provide enzyme storage stability benefits in aqueous products.

For use in the present invention, we prefer glyceryl ethers of the formula $$RO(C_nH_{2n}O)_x(CH_2CH(OH)CH_2O)_yH$$

wherein R is an alkyl or alkenyl group having from 9 to 25 carbon atoms, n is 2 to 4, x is from 0 to 15 (preferably 1 to 6), y is from 1 to 20 (preferably from 1 to 7) and the alkylene oxide and glycerol groups are arranged in random or block formation, the molecule ideally being terminated by at least one glycerol group.

The boric acid or the boron-equivalent thereof may be selected from boric acid itself, boric oxide, borax and other alkali metal borates capable of reacting with the glyceryl ether surfactant, such as sodium or potassium ortho-, meta- and pyroborates. The level of boric acid or boron- equivalent is preferably from 0.1 to 20% by weight of the composition, more preferred 0.5–10%, most preferred 1.0 to 5%.

The liquid compositions according to the invention preferably have a pH of above 7.5, ideally between 8.5 and 11.0 (at 25° C.).

The enzymes to be incorporated can be proteolytic, lipolytic, amylolytic and cellulolytic enzymes as well as mixtures thereof. They may be of any suitable origin, such as vegetable, animal, bacterial, fungal and yeast-origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases. The present invention is of particular benefit for enzymatic liquid detergents incorporating bacterial proteases of which the pH-optima lie in the range between 8.0 and 11.0, but it is to be understood that enzymes with a somewhat lower or high pH-optimum can still be used in the compositions of the invention, benefiting from it.

Suitable examples of proteases are the subtilisins which are obtained from particular strains of *B. subtilis* and *B. licheniformis*, such as the commercially available subtilisins Maxatase® (ex Gist-Brocades N.V., Delft, Holland) and Alcalase® (ex Novo Industri A/S, Copenhagen, Denmark).

As stated above, the present invention is of particular benefit for enzymatic liquid detergents incorporating enzymes with pH-activity and/or stability optima of above 8.0, such as enzymes also commonly called high-alkaline enzymes.

Particularly suitable is a protease, obtained from a strain of Bacillus, having maximum activity throughout the pH-range of 8–12, developed and sold by Novo Industri A/S under the registered trade name Esperase®. The preparation of this enzyme and analogous enzymes is described in British patent specification No. 1,243,784 of Novo.

Lipolytic enzymes be chosen from among a wide range of lipases: in particular the lipases described in for example the following patent specification Nos., EP 0214761 (Novo) and especially lipases showing immunological cross-recactivity with anisera raised against lipase from *Thermomyces lanuginosus* 22070 , EP 0205208 (Unilever) and EP 0206390 (Unilever), and especially lipases showing immunological cross-reactivity with antisera raised against lipase from *Chromobacter viscosum* var lipolyticum NRRL B-3673 and FERM-P 37833, also the lipases described in specification Nos. WO 87/00859 (Gist-Brocades) and EP 0204284 (Sapporo Breweries). Suitable in particular are for example the following commercially available lipase preparations: Novo Lipolase, Amano lipases CE, P, B, AP, M-AP, AML and CES, and Meito lipases MY-30, OF, and PL, also esterase MM. Lipozym, SP225, SP285, Saiken lipase, Enzeco lipase, Toyo Jozo lipase and Diosynth lipase (Trade Marks).

High-alkaline amylases and cellulases can also be used, e.g. alpha-amylases obtained from a special stain of *B. licheniformis*, described in more detail in British patent specification No. 1,296,839 (Novo).

The amount of enzymes present in the liquid composition may vary from 0.001 to 10% by weight, and preferably from 0.01 to 5% by weight.

Preferably liquid detergent compositions according to the invention are internally structured in that the composition comprises sufficient dissolved electrolyte to result in a surfactant structure, wherein the structure is due to primary ingredients.

One common type of internal surfactant structure is sometimes referred to as a dispersion of lamellar droplets (lamellar dispersion). The dispersed structuring phase in these liquids is generally believed to consist of an onion-like configuration comprising concentric bilayers of detergent active molecules, between which water is trapped (aqueous phase). These configurations of active material are sometimes referred to as lamellar droplets. It is believed that the close packing of these droplets enables the solid materials to be kept in suspension. The lamellar droplets are themselves a sub-set of lamellar droplets are themselves a sub-set of lamellar structures which are capable of being formed in detergent active/aqueous electrolyte systems. Lamellar systems are, in general, a category of structures which can exist in detergent liquids.

Electrolyte may be only dissolved in the aqueous continuous phase or may also be present as suspended solid particles. Particles of solid materials which are insoluble in the aqueous phase may be suspended alternatively or in addition to any solid electrolyte particles.

Surprisingly it has been found that stable active-structured detergent compositions containing significant levels of nonionic detergent surfactants can be formulated, provided that the glyceryl ether nonionic materials as described above are used. It has also been found that when this specific nonionic material is used sometimes an improved detergency can be observed.

Surprisingly, it has been found that the use of nonionic materials according to formula I, provides particularly stable, internally structured liquid detergent compositions of good detergency even at relatively high levels of nonionic detergent active materials.

The nonionic materials for use in compositions according to the present invention may be prepared by optionally subjecting a $C_8$–$C_2$ higher alcohol to an addition reaction with alkylene oxide, especially ethylene oxide, followed by epichlorohydrin or glycidol in an inert atmosphere using an acid or alkali catalyst, In the case of epichlorohydrin, the alcohol is ethoxylated with 0 to 15 moles of alkylene oxide preferably ethylene oxide per molecule according to well-known methods. The product is subsequently reacted with 1 to 2 moles of epichlorohydrin in the presence of an acid catalyst and the product is treated with potassium hydroxide, acetylated and hydrolysed.

Alternatively, after possible ethoxylation of the alcohol as already described, the ethoxylate is treated with 1 to 20 moles of glycidol in the presence of either an alkaline or acidic catalyst. After the reaction the catalyst is neutralised, dehydrated in vacuum, and solids produced by neutralisation filtered off to leave the desired nonionic.

When an acid catalyst is used, this may be sodium hydroxide, potassium hydroxide, sodium or potassium metal or sodium methoxide, the reaction temperature being between 30° C. and 90° C.

In a first preferred embodiment of the invention glycerol terminated nonionics are used which comprise no alkylene oxide groups and one glycerol group. Preferably these materials contain a $C_8$–$C_{12}$ alkyl or alkenyl chain, more preferably at least 60%, most preferred more than 80% of the alkyl or alkenyl chain is $C_{10}$. Compositions comprising these nonionic materials are especially advantageous in that they are good detergents, especially when the nonionic materials are used in combination with anionic surfactants and/or other nonionic surfactant materials.

Preferably the detergent active material for use in liquid detergent compositions according to the invention contains:

(i) from 10 to 100% by weight of the nonionic material of formula (I), (ii) from 90 to 0% of an anionic surfactant, a nonionic surfactant other than those of formula (I), or mixtures thereof.

Especially preferred are compositions comprising a detergent active material containing:

(i) from 20 to 40% by weight of the nonionic material of formula (I), (ii) from 80 to 60% by weight of an anionic surfactant, nonionic surfactant other than of formula (I), or mixtures thereof.

These mixture of detergent active material comprising from 20 to 40 % by weight of the nonionic material of formula (I) are especially preferred when a $C_{8-12}$ mono glycerol material is used as the nonionic material of formula I.

According to a second preferred embodiment of the present invention compositions contain high levels on active of the nonionic materials of formula I, for instance from 40–90% on active, preferably from 60 to 80% on active, the remaining active materials being selected from anionic materials and nonionic materials not of formula I. These compositions are especially advantageous when a material of formula I is used wherein x is from 1–6 more preferably 2 and y is from 1–3 especially 1 and the molecule is a glycerol terminated molecule. These compositions are surprisingly stable at high levels of nonionic materials.

Suitable anionic surfactants for use in compositions of the invention are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulponate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

It is also possible, and sometimes preferred, to include other anionic materials in the composition such as alkali metal soaps of a fatty acid, especially a soap of an acid having from 12 to 18 carbon atoms, for example oleic acid, ricinoleic acid, and fatty acids derived from castor oil, rapeseed oil, alkyl succinates, groundnut oil, coconut oil, palmkernel oil or mixtures thereof. The sodium or potassium soaps of these acids are preferably used.

As described above, compositions according to the present invention may comprise, in addition to the nonionics of formula I, one or more other nonionic surfactants.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic material may also comprise an alkyl poly saccharide surfactant having the formula $RO(C_nH_{2n}O)_xZ_y$ or $RCOO(C_nH_{2n}O)_xZ_y$ wherein Z is a moiety derived from a reducing saccharide containing from 5 to 6 carbon atoms, preferably a glucose, galactose, glucosyl or galactosyl residue or mixtures thereof; R is a hydrophobic group selected from the group consisting of alkyl, alkenyl, alkyl phenol, hydroxy alkyl phenyl or hydroxy alkyl groups or mixtures thereof in which the alkyl groups contain from about 8 to about 20 carbon atoms, preferably from about 10 to about 16 carbon atoms, most preferably from about 12 to about 14 carbon atoms. n is 2 to 4 and x is 0 to 30, preferably 0 to 10 most preferably 0. The alkyl chain can be attached to the sugar residue at the 1-, 2-, 3-, 4-, 5 or 6 positions. Y is a number from 1 to 10, preferably 1 to 4, most preferably 1 to 2.

The intersaccharide bonds can be e.g. between the one position of the additional saccharide units and the 2-, 3-, 4- and/or 6 positions on the preceding saccharide units.

Additionally the hydroxyl groups on the sugar residue may in part be substituted at the 1-, 2-, 3-, 4-, or 6 positions by short alkyl chains of $C_1$ to $C_4$, preferably $C_2$.

In many (but not all) cases, the total detergent active material may be present at from 2% to 60% by weight of the total composition, for example from 5% to 40% and typically from 10% to 30% by weight; when mixtures of other surfactants with the glyceryl ether nonionic surfactants are used, the relative weight ratio varies from 1:1 to 1:10. When a soap is incorporated, the amount thereof is preferably from 1–40% by weight.

The compositions preferably contain electrolyte in an amount sufficient to bring about structuring of the detergent active material. Preferably though, the compositions contain from 1% to 60%, especially from 10 to 45% of a salting-out electrolyte. Salting-out electrolyte has the meaning ascribed to it in specification No. EP-A-79 646. Optionally, some salting-in electrolyte (as defined in the latter specification) may also be included, provided it is of a kind and in an amount compatible with the other components and the composition is still in accordance with the definition of the invention claimed herein. Some or all of the electrolyte (whether salting-in or salting-out), or any substantially water insoluble salt which may be present, may have detergency builder properties.

Compositions according to the invention are preferably physically stable in that they yield no more than 2% by volume phase separation when stored at 25° C. for 21 days from the time of preparation. Compositions according to the invention preferably have a viscosity of less than 2,000 mPa.s, more preferably less than 1,000 mPa.s, most preferably between 20, and 500 mPa.s at 21 $s^{-1}$.

In the case of blends of surfactants, the precise proportions of each component which will result in such stability, and viscosity will depend on the type(s) and amount(s) of the electrolytes, as is the case with conventional liquids.

Although the invention is also of benefit for use in unbuilt liquid detergents, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric-softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorous-containing inorganic detergency builders, when present, include water-soluble salts, especially alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in U.K. patent specification No. GB 1 302 543.

Examples of organic detergency builders, when present, include the alkali metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, CMOS, mellitic acid, benzene polycarboxylic acids and citric acid.

Compositions according to the invention preferably also comprise viscosity adjusting agents such as viscosity regulating polymers. Viscosity and/or stability regulating polymers which are preferred for incorporation in compositions according to the invention include deflocculating polymers for example these having a hydrophilic backbone and at least one hydrophobic side chain. Such polymers are described in our co-pending British patent application Nos. 8813978.7 (corresponding to EP 346995), 8924479.2, 8924478.4 and 8924477.6.

Other polymers which could advantageously be used for viscosity regulation are described in EP 301,882 (Unilever PLC) and EP 301,883 (Unilever PLC). Preferably the amount of deflocculating and/or viscosity regulating polymer is from 0.1 to 5% by weight of the total composition.

Although it is possible to incorporate minor amounts of hydrotropes other than water-miscible solvents, we prefer that the compositions of the present invention are substantially free from hydrotropes. By hydrotrope is meant any water-soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palmkernel fatty acids and coconut fatty acids, fabric softeners such as clays, amines and amine oxides, lather depressants, inorganic salts such as sodium sulphate, and, usually present in very minor amounts, fluorescent agents, perfumes, and colourants.

Other conventional materials may also be present in the liquid detergent compositions of the invention, for example soil-suspending agents, hydrotropes, corrosion inhibitors, dyes, perfumes, silicates, optical brighteners, suds boosters, suds depressants, germicides, anti-tarnishing agents, opacifiers, fabric-softening agents, buffers and the like.

The compositions of the invention may optionally contain the polyhydroxy compounds disclosed in CA 1092036, but it is pointed out that such materials are not essential to the invention. Examples of such polyhydroxycompounds are diols such as 1,2-propanediol, ethylene glycol, erythritan and polyols such as glycerol, sorbitol and manitol. Preferably the amount of glycerol is less than 10%, more preferred less than 5% most preferred less than 3% especially preferred are compositions which are substantially free from glycerol.

Other enzyme stabilizing materials may also be present, to provide still further stabilisation, such as calcium salts, alkanolamines, sulphites, low molecular weight carboxylic acids (eg. formate), fatty acids, glycine and/or cross-linked polyacrylates.

The amount of water in the composition is preferably more than 5% such as from 10 to 70% by weight.

In use, the liquid detergent compositions are generally diluted with water, and subsequently fabrics are treated with the aqueous liquor. Preferably, the aqueous liquor comprises less than 5%, more preferably between 0.2 and 2% by weight of the detergent composition.

The invention will be illustrated by means of the following examples:

EXAMPLES I TO III (i) Preparation of glyceryl ether surfactant 280 g of SYNPROL (a commercial mixture of $C_{13}$ and $C_{15}$ primary alcohols - ex ICI) was heated to 80° C. in the presence of 0.8 ml of antimony pentachloride. 270 g of ethylene oxide was led into the mixture by means of a gas inlet tube. When the reaction was complete the gas inlet tube was replaced by a dropping funnel and 125 g of epichlorohydrin was added over 4 hours. After cooling, the mixture was dissolved in 2 liters ether and 90 g of powdered potassium hydroxide was added and the mixture was stirred for 3 hours at room temperature. After filtering, the solvent was removed under vacuum, 400 g of acetic anhydride and 1 g of tetra ethylammonium bromide were added to the residue and heating continued for 1 hour. After removal of most of the pyridine, acetic acid and anhydride under vacuum, the residue dissolved in chloroform solution was dried and evaporated and the residue dissolved in 2 liters methanol and 1 g sodium metal was added. The mixture was stirred for 4 hours at room temperature and Dowex ion-exchange resin added to neutralise the solution. The solution was treated with charcoal to remove colour, filtered and the solvent removed to yield 465 g of the glycerol terminated alcohol ethoxylate of the approximate formula:

$$RO(C_2H_4O)_xCH_2CH(OH)CH_2OH$$

where x is between 4.0 and 4.5. This material is designated S-4G in the following tests.

Compositions According to the Invention

Compositions were prepared, using standard mixing techniques, according to the following table.

| Example No: | 1 | 2 | 3 |
|---|---|---|---|
| Ingredients (wt %) | | | |
| S-4G | 10.5 | 21.0 | 20.0 |
| LAS[1] | 10.0 | 3.6 | 3.4 |
| Prifac[2] | — | 5.4 | 5.1 |
| Triethanolamine | 2.0 | 2.0 | 1.9 |
| Sodium citrate | 7.0 | 3.0 | 2.9 |
| Borax | 3.0 | 3.0 | 2.9 |
| Sodium toluenesulphonate | 4.0 | — | — |
| Ethanol | — | 5.0 | 4.8 |
| Savinase (Gu/mg) | 10 | 10 | 10 |
| Water | | balance | |
| pH | 9.2 | 9.2 | 9.2 |

These compositions were tested for enzyme stability at 37° C. using the method described in CA 1092036.

For Example 1, the enzyme half life was found to be about 12 days. When the glyceryl ether nonionic surfactant was replaced by SYNPERONIC A7 which is a nonionic surfactant obtained by ethoxylating SYNPROL with an average of 7 moles of ethylene oxide per molecule, the half life was less than 1 day.

For example 2, the enzyme half-life was found to be about 7 days. When a similar composition without borax was tested the half-life was found to be less than 2.5 days.

For Example 3, the enzyme half-life was found to be about 20 days but when the glyceryl ether nonionic was replaced by SYNPERONIC A7, the half-life was less than 2.5 days.

These results show the storage benefits obtainable with the compositions of the invention.

EXAMPLE IV

In this example the stability areas of ternary systems of NaCl, linear alkyl benzene sulphonate and nonionic materials are quantified. In this context a stability area is an area wherein stable active-structured compositions are formed. The stable area can be represented in a two-dimensional graph, the x-direction representing the mole fraction of nonionic material on the total of anionic to nonionic material, the y-direction specifying the percentage of NaCl present, at a constant level of surfactant materials of about 20% by weight. The surface area of the stable area provides a rough indication of general performance as to stability of the system, a greater surface area indicating a better general performance.

A ternary system according to the present invention was tested by using as the nonionic material a $C_{13.6}EO_{4.5}G$ indicating an average value of 13.6 for the carbon atoms in the alkyl chain, on average 4.5 ethoxy groups attached to the chain and one glycerol group terminating the molecule.

For comparison, a nonionic material $C_{13.6}EO_7$ was used as the nonionic material, and also $C_{13.6}EO_{11}$ was used as the nonionic material.

Figure 1B:
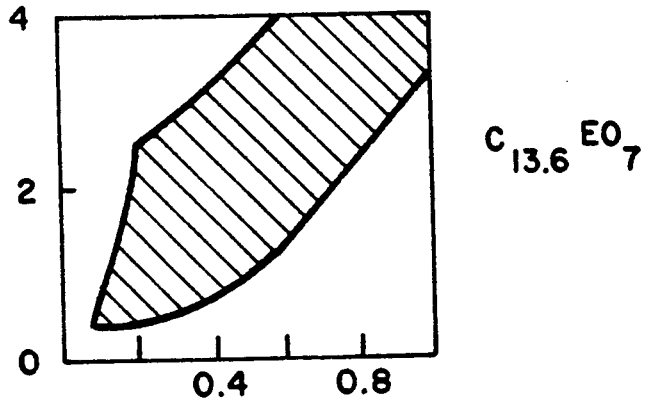
Figure 1C:
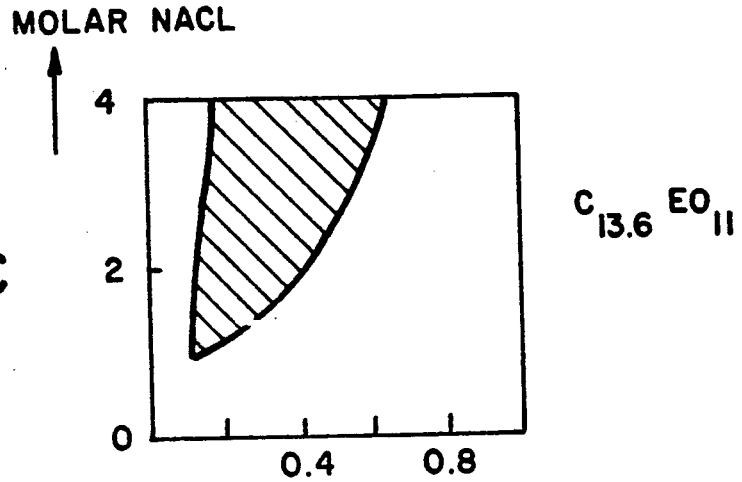

The results of the tests are given in FIGS. 1*a*, 1*b* and 1*c* which show the area wherein stable lamellar systems are formed. From these figures it is clear that the use of a nonionic according to the invention, provides more flexibility to formulate the composition in order to obtain a stable active-structured composition. Especially the use of high levels of nonionic materials at relatively low levels of electrolyte provides only lamellar compositions when using nonionic material according to the invention.

EXAMPLES V-VIII

Dobanol 91 (a commercially available mixture of $C_8$ to $C_{12}$ alcohols, ex Shell) was treated with ethylene oxide followed by epichlorohydrin and the mixture worked up as in Example I to give a product of the same general formula as in Example I, where x is approximately 2 and Y is 1. This material is designated Dob 2G.

The following compositions were prepared by standard mixing techniques:

| Example | V | VI | VII |
|---|---|---|---|
| Ingredients (wt. %) | | | |
| Synperonic A7 | 3.7 | 13.3 | 13.3 |
| Dob 2G | 9.6 | — | — |
| LAS | 1.5 | 1.5 | 1.5 |
| Prifac | 2.5 | 2.5 | 2.5 |
| Triethanolamine | 2 | 2 | 2 |
| Sodium citrate | 3 | 3 | 3 |
| Glycerol | — | — | 4 |
| Borax | 3 | 3 | 3 |
| Savinase (GU/mg) | 10 | 10 | 10 |
| Water | | balance | |
| pH | 9.2 | 9.2 | 9.2 |

Composition V according to the invention was a stable pourable active-structured detergent composition.

For Example V the enzyme halflife time was found to be about 9 days. When for comparison the glyceryl ether nonionic was replaced by SYNPERONIC A7 (Example VI), the halflife was less than 2 days. For comparative Example VII, in which glycerol was combined with the borax, the halflife time was less than 5 days.

I claim:

1. An aqueous liquid detergent comprising (a) water;

(b) a glyceryl ether of an alkoxylated nonionic surfactant of the formula $$RO(C_nH_{2n}O)_x(CH_2CH(OH)CH_2O)_yH$$

wherein R is an alkyl or alkenyl group having from 8 to 25 carbon atoms, n is 2 to 4, x is from 1 to 15, y is from 1 to 20 and the alkylene oxide and glycerol groups are arranged in random or flock formation;

(c) from 0.001 to 10% by weight of enzymes selected from the group consisting of proteolytic, lipolytic, amylolytic and cellulolytic enzymes; and (d) from 0.1 to 5% by weight of boric acid or a boron-equivalent thereof capable of reacting with said surfactant;

said composition comprising from 2 to 60% by weight of detergent active materials wherein said detergent active materials comprise (i) from 10 to 100% by weight of the glyceryl ether of the alkoxylated nonionic material of (a); and (ii) from 90 to 0% of an anionic surfactant, a nonionic surfactant other than those of formula (I), or mixtures thereof;

wherein the ratio by weight of the glyceryl ether of (b) to the boric acid or boron-equivalent of (d) is greater than 1:1.

2. A composition according to claim 1, wherein the material of formula I is terminated with at least one glycerol group.

3. A composition according to claim 1, further comprising from 1 to 60% of salting out electrolytes.

4. A method of treating fabrics, comprising the step of contacting said fabrics with an aqueous liquor comprising an aqueous liquid detergent composition according to claim 1.

* * * * *